US011564469B2

(12) United States Patent
Maletti

(10) Patent No.: US 11,564,469 B2
(45) Date of Patent: Jan. 31, 2023

(54) MULTIFUNCTIONAL DEVICE FOR THE TREATMENT OF HAIR AND SKIN

(71) Applicant: MALETTI S.P.A., Fellegara di Scandiano (IT)

(72) Inventor: Guido Maletti, Scandiano (IT)

(73) Assignee: MALETTI S.P.A., Fellegara di Scandiano (IT)

( * ) Notice: Subject to any disclaimer, the term of this patent is extended or adjusted under 35 U.S.C. 154(b) by 470 days.

(21) Appl. No.: 16/801,198

(22) Filed: Feb. 26, 2020

(65) Prior Publication Data

US 2020/0288838 A1 Sep. 17, 2020

(30) Foreign Application Priority Data

Mar. 14, 2019 (IT) ..... 202019000000875

(51) Int. Cl.

| | |
|---|---|
| ***A45D 19/14*** | (2006.01) |
| ***A45D 19/16*** | (2006.01) |
| ***A61H 33/06*** | (2006.01) |
| ***A45D 19/00*** | (2006.01) |
| ***A61Q 5/02*** | (2006.01) |

(52) U.S. Cl.

CPC ..... *A45D 19/14* (2013.01); *A45D 19/16* (2013.01); *A61H 33/06* (2013.01); *A45D 19/005* (2021.01); *A45D 2019/0033* (2013.01); *A61H 2201/5007* (2013.01); *A61H 2201/5082* (2013.01); *A61Q 5/02* (2013.01)

(58) Field of Classification Search

CPC ..... A45D 19/14

USPC ..... 4/515, 619, 596, 615

See application file for complete search history.

(56) References Cited

U.S. PATENT DOCUMENTS

| | | | | |
|---|---|---|---|---|
| 5,099,865 | A * | 3/1992 | Flannery | A45D 19/14 132/212 |
| 6,161,227 | A * | 12/2000 | Bargenquast | A47K 5/1217 134/58 R |
| 7,099,571 | B2 | 8/2006 | Yao | |
| 2005/0015873 | A1* | 1/2005 | Hansen | E03C 1/18 4/519 |
| 2005/0276585 | A1 | 12/2005 | Yao | |
| 2011/0239363 | A1* | 10/2011 | Nagamatsu | A45D 19/06 4/519 |
| 2019/0159567 | A1* | 5/2019 | Maletti | A45D 19/10 |

FOREIGN PATENT DOCUMENTS

| | | |
|---|---|---|
| CN | 2614518 | 5/2004 |
| EP | 1386598 | 3/2005 |
| WO | 2011080930 | 7/2011 |

* cited by examiner

*Primary Examiner* — Lori L Baker

(74) *Attorney, Agent, or Firm* — Pearne & Gordon LLP; John P. Murtaugh

(57) ABSTRACT

A multifunctional device for the treatment of a patient's hair and skin including a box-shaped body 2 in which a tank 4 for the production of steam V is inserted. The multifunctional device further includes a heater 5, inside the tank 4 for heating a volume of water W contained in the tank 4, and a dispenser 6 for dispensing, through a first conduit 7, steam V from an outlet mouth 8. The device also includes a supply conduit 9, with a second end 9*b* in fluid communication with a water supply source, and a filter 10 intercepting the supply conduit 9, for treating the incoming water, transforming it into demineralized water.

14 Claims, 6 Drawing Sheets

MULTIFUNCTIONAL DEVICE FOR THE TREATMENT OF HAIR AND SKIN

BACKGROUND OF THE INVENTION

Field of the Invention

The present invention relates to a multifunctional device for the treatment of hair and skin.

Said device finds its field of application in beauty salons, hairdressing salons, beauty farms and other places where services for the treatment of the body are provided, and in particular of hair and skin.

Description of Related Art

Recent developments in the area of hair and skin care have gradually placed the known hair washing and/or colouring treatments alongside the use of sources of steam to be applied during the above-mentioned treatments.

To meet these recent market developments, the known backwash chair units, equipped with a chair on which the patient sits and a washbasin within which the patient's hair is treated, are generally integrated with, or associated with, systems for the production of steam.

In some cases the backwash chair units have, inside the washbasin, a steam outlet for the treatment of hair.

This type of solution is particularly appreciated in the field because it has a reduced encumbering volume, the steam production system being contained inside the chair and because it has no visual aesthetic impact since, both in use and at rest, it remains hidden inside the chair.

Although this type of solution has a large preference of use, given the reduced encumbrance, it does not lack some drawbacks.

Firstly, in the case of failure or maintenance, access to the system that produces steam is not always very easy, and this makes the ordinary maintenance of the system very difficult.

Secondly, for the manager of the beauty salon, the replacement of a traditional backwash chair unit with one capable of also delivering steam, has a strong economic impact considering that the steam system has a design strongly dedicated to the type of chair.

Adapting an existing chair with a system able to deliver steam is not always possible and in any case requires the substitution of some important parts of the backwash chair unit which make the operation somewhat expensive.

For this reason there are other systems, so-called carts, equipped with a tube for the delivery of steam, which are introduced inside the washbasin of the backwash chair unit during the treatments.

These systems have a water tank inside which the same is heated for the production of steam.

Whenever the water is depleted, the operator must provide for the disassembly of the tank to replenish the water necessary for the production of steam.

This system, although much cheaper than the backwash chair unit with integrated steam, disadvantageously requires frequent water refilling operations.

Moreover, considering the operation is recommended using demineralized water, it may occur that when the operator needs to provide a treatment, he or she uses normal water, risking damaging the system.

The object of the present invention is to propose a multifunctional device for the treatment of hair and skin able to solve the problems of the prior art.

In particular, an object of the present invention is to propose a multifunctional device that has the characteristics of a cart and is capable of solving the maintenance problems of the known systems.

A further object of the present invention is to provide a multifunctional device capable of dispensing, in addition to steam, other types of treatments.

The stated technical task and the specified objects are substantially reached by a multifunctional device having the characteristics expressed in one or more of the appended claims.

BRIEF SUMMARY OF THE INVENTION

In particular, an object of the present invention is to provide a multifunctional device for the treatment of patient's hair and skin.

The device essentially comprises a box shaped body internally containing a tank for producing steam and a keypad connected to a control and command board.

Advantageously the keypad, together with the control and command board, allows a setting of working conditions of the device.

According to an aspect of the present invention, the keypad comprises a first plurality of keys for the selection of programs of hair and skin treatment. Thus, advantageously, a user can easily and immediately set a program of treatment for the patient.

The tank for producing steam is configured to contain a volume of water and internally comprises heating means configured to heat the mentioned volume of water. In other words, the tank internally comprises a heater configured to heat water contained in the tank itself in order to generate steam.

The steam generated is dispended through dispensing means, in other words, the device comprises a dispenser for the steam.

According to an aspect of the present invention, the dispenser comprises a first conduit for dispensing steam in fluid communication with the tank; the dispenser further comprises an outlet mouth for concentrating a flow of steam.

According to an aspect of the present invention, the dispenser further comprises a second conduit in fluid communication below with the tank and connected above to a nebulizer. Advantageously, the second conduit allows the dispensing of cold atomized water.

According to an aspect of the present invention, the dispenser is controllable through the keypad which comprises a second plurality of keys for varying the amount of steam dispensed by the dispenser.

The tank can be refilled with water, in detail, a supply conduit having a first end in fluid communication with the tank and a second end in fluid communication with a water supply source is adapted to supply the tank, preferably following a command of the keypad.

According to an aspect of the present invention the keypad comprises a third plurality of keys configured to allow the automatic refilling of the tank upon exceeding a minimum water level value in the tank.

According to another aspect of the present invention, the supply conduit comprises filtering means configured to treat the incoming water. In detail, the supply conduit comprises a filter configured to treat the incoming water, transforming it into demineralized water.

According to an aspect of the present invention, the control and command board comprises a logical counter adapted to measure the time of use of the filter. Advantageously, the control and command board is thus able to indicate a user the state of wear of the filter, consequently, an user can be aware of the remaining functional life of the filter.

According to an aspect of the present invention, the device comprises disinfectant means configured to disinfect and ionize the steam in input to the dispenser. In other words, the device comprises a disinfector.

According to an aspect of the present invention the disinfector is placed in correspondence of the supply conduit and near the tank.

Moreover, the disinfector is configured to irradiate the supply conduit itself.

According to another aspect of the present invention the disinfector is an UV lamp.

According to an aspect of the present invention the tank internally comprises at least a sensor configured to detect information about the temperature inside the tank itself. Advantageously and consequently, it is possible to signal an user an excess of temperature, and/or to activate a safety blockage of the device.

According to an aspect of the present invention the tank comprises a first sensor adapted to detect a rise in temperature inside the tank, and, as soon as a first threshold value is exceeded, to command the control and command board a further action.

The mentioned further action can be an activation of a topping up of water to the tank or a user signalling, through suitable acoustic and/or visual indicators, having exceeded the minimum water volume level contained in the tank.

According to a further aspect of the present invention, the mentioned first sensor is a thermostat.

According to an aspect of the present invention, the tank comprises a second sensor adapted to detect the rise in temperature inside the tank, and, as soon as a second threshold value is exceeded, to command the control and command board to activate a safety blockage of the device.

According to a further aspect of the present invention, the mentioned second sensor is a thermostat.

In particular, the mentioned second threshold value is greater than the mentioned first threshold value.

Another object of the present invention is to provide a backwash chair unit comprising the multifunctional device for the treatment of patient's hair and skin.

The backwash chair unit essentially comprises, apart from the multifunctional device, also a chair and a washbasin.

In detail, the chair is configured for accommodating a patient in a suitable position to be subjected to a hair and skin treatment while the washbasin is configured to house the head of a patient.

According to an aspect of the present invention, the washbasin provides a hood on its top. In particular, the hood is adapted to confine a volume of steam and/or the cold atomized water dispensed by the dispenser.

The hood further comprises a pair of lateral openings which, advantageously, facilitate the insertion of the operator's hands and allow skin massage and hair washing.

The hood has a seat below configured to accommodate the dispenser so that the steam and/or cold water is dispensed inside a closed volume defined below by the washbasin and above by the hood.

According to an aspect of the present invention, the hood is made of transparent polycarbonate.

BRIEF DESCRIPTION OF THE DRAWINGS

Further characteristics and advantages of the present invention will become more apparent from the indicative, and thus non-limiting, description of a preferred, but not exclusive, embodiment of a multifunctional device for the treatment of hair and skin as illustrated in the accompanying drawings, in which.

DETAILED DESCRIPTION OF PREFERRED EMBODIMENTS OF THE INVENTION

Figure 1:
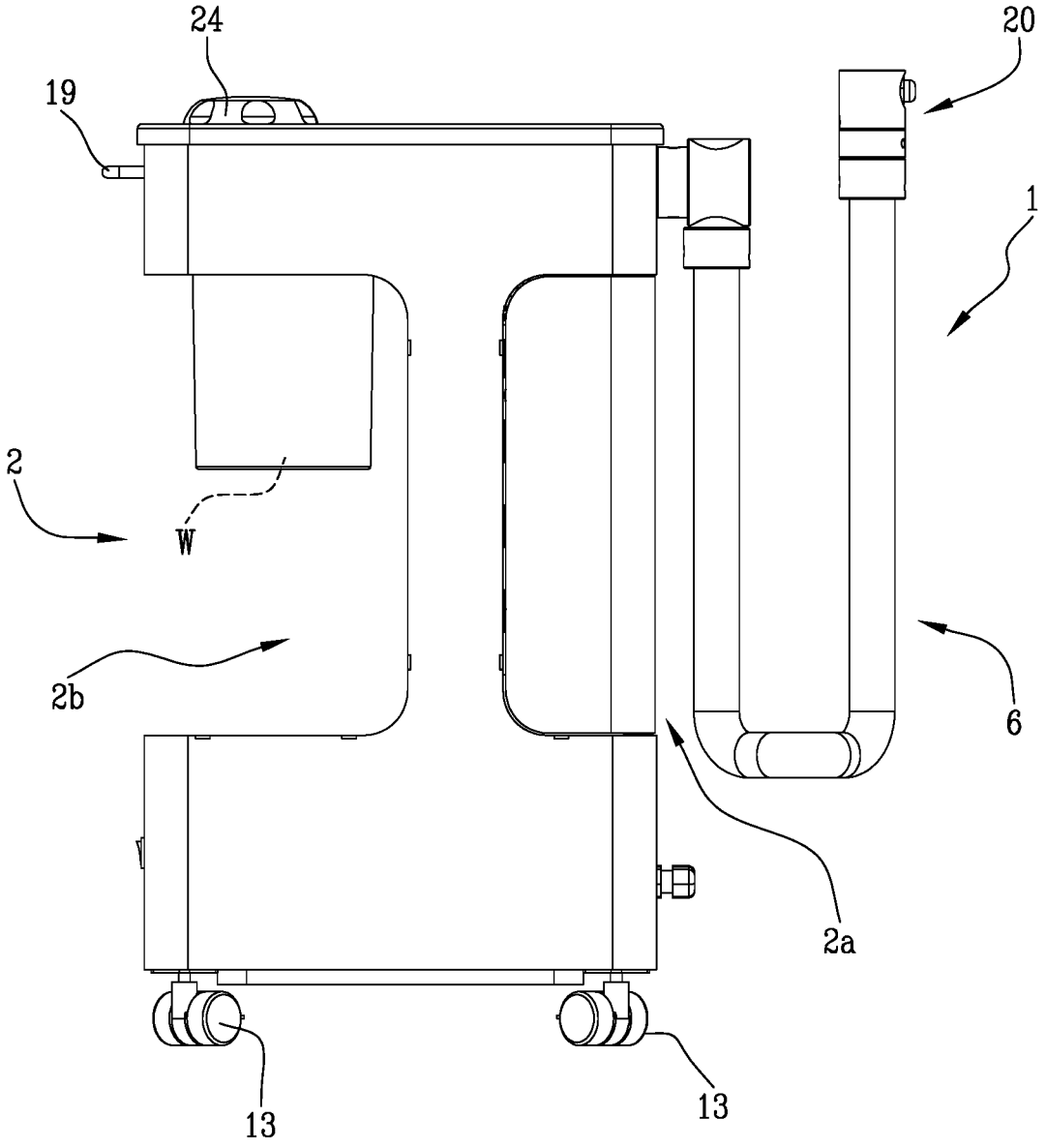
FIG. 1 shows a side view of a multifunctional device for the treatment of hair and skin in accordance with the present invention.
Figure 2:
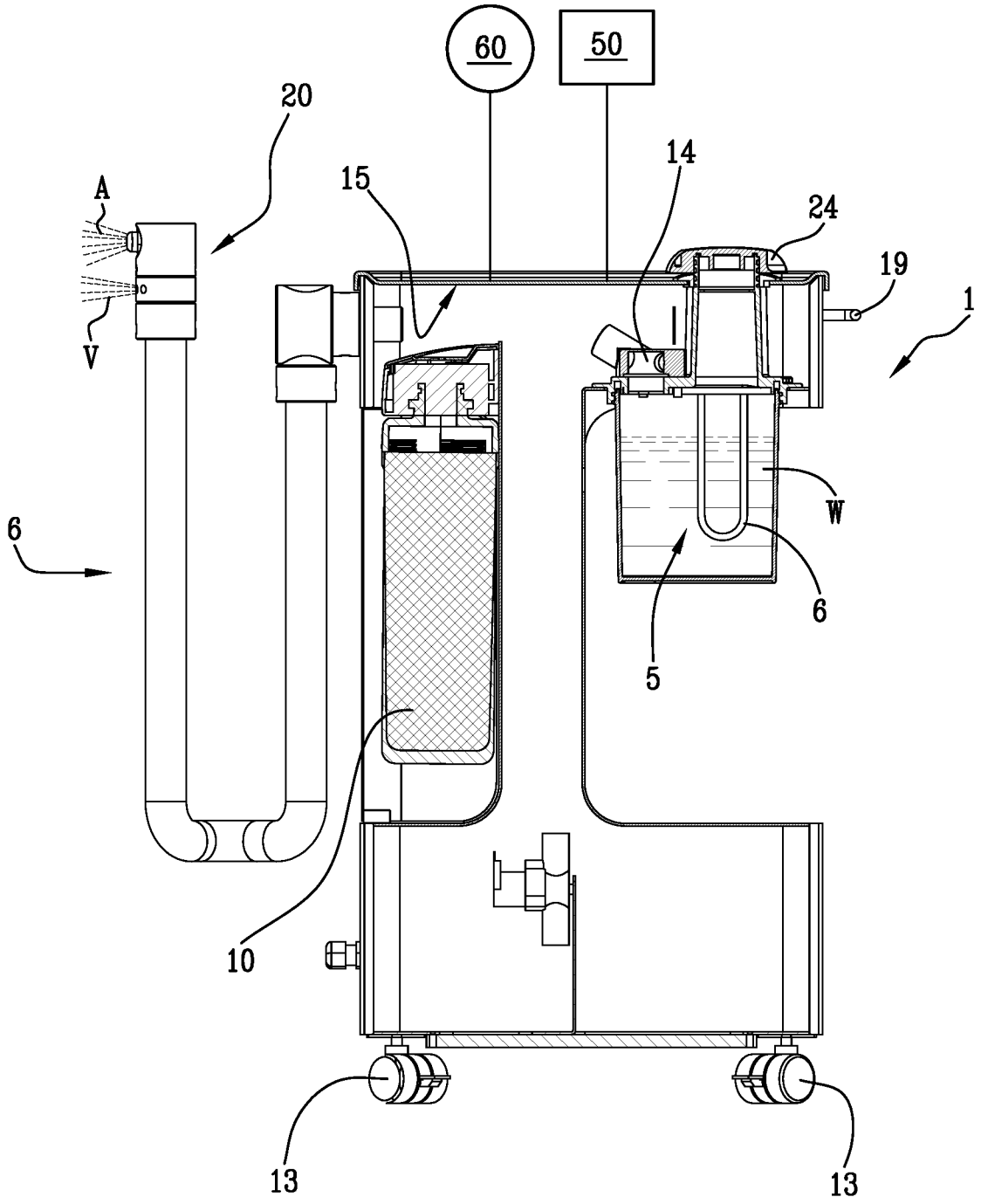
FIG. 2 shows a sectional side view of the device of FIG. 1.
Figure 3:
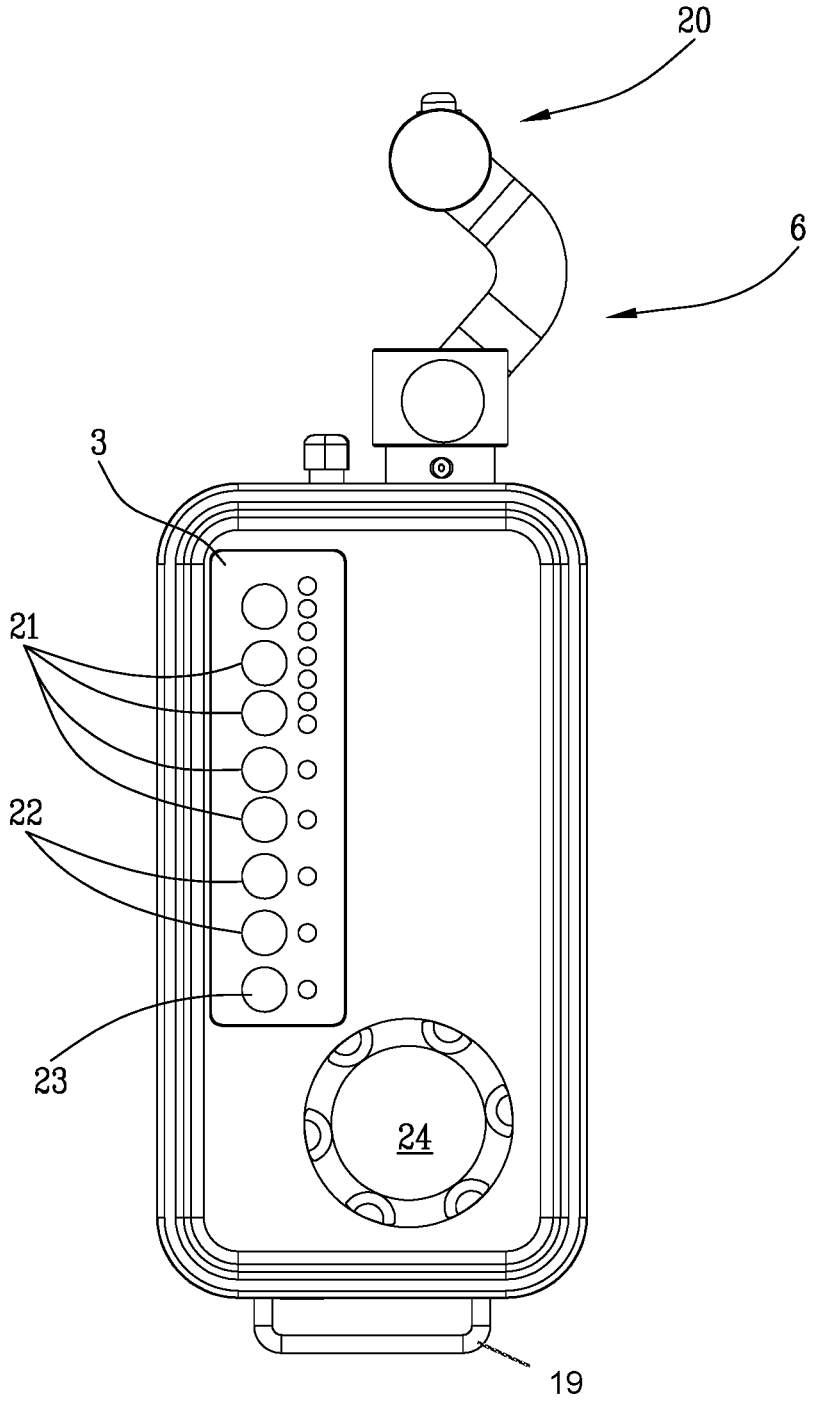
FIG. 3 shows a plan view of the device of FIG. 1.
Figure 4:
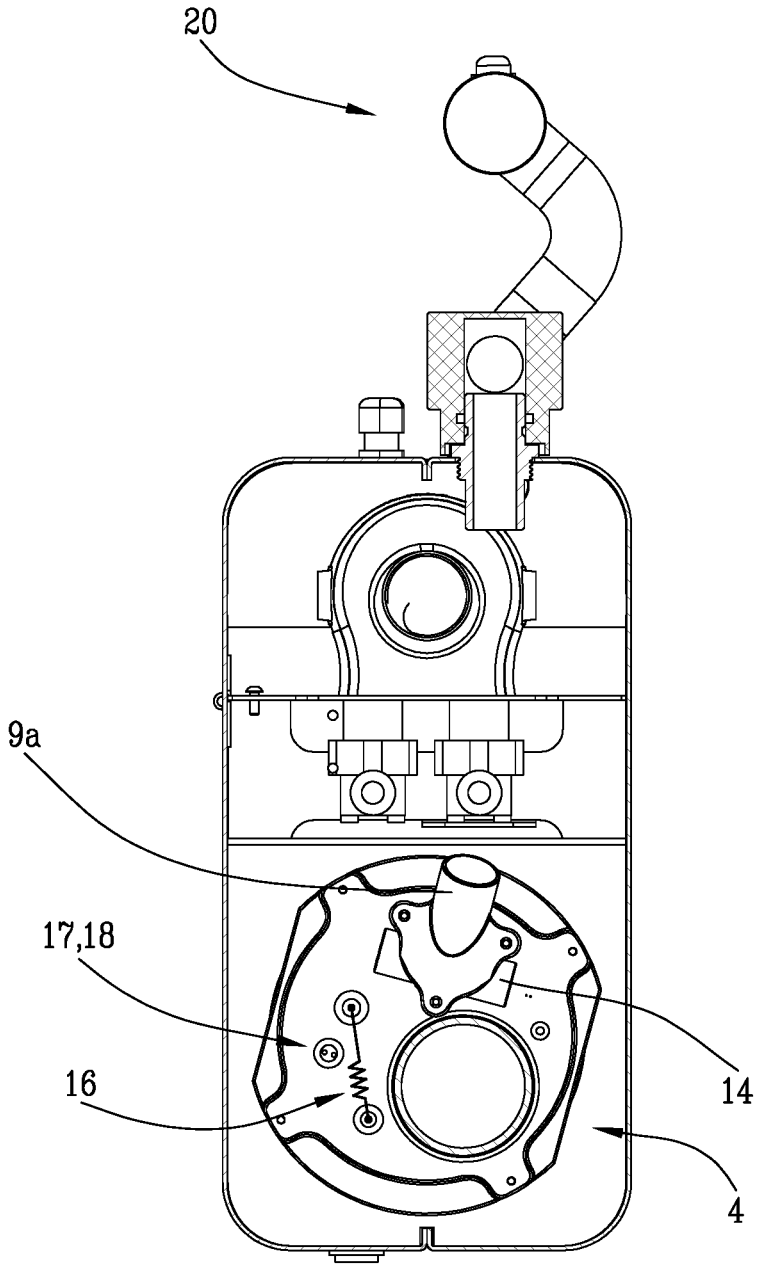
FIG. 4 shows a sectional plan view of the device of FIG. 1.
Figure 5:
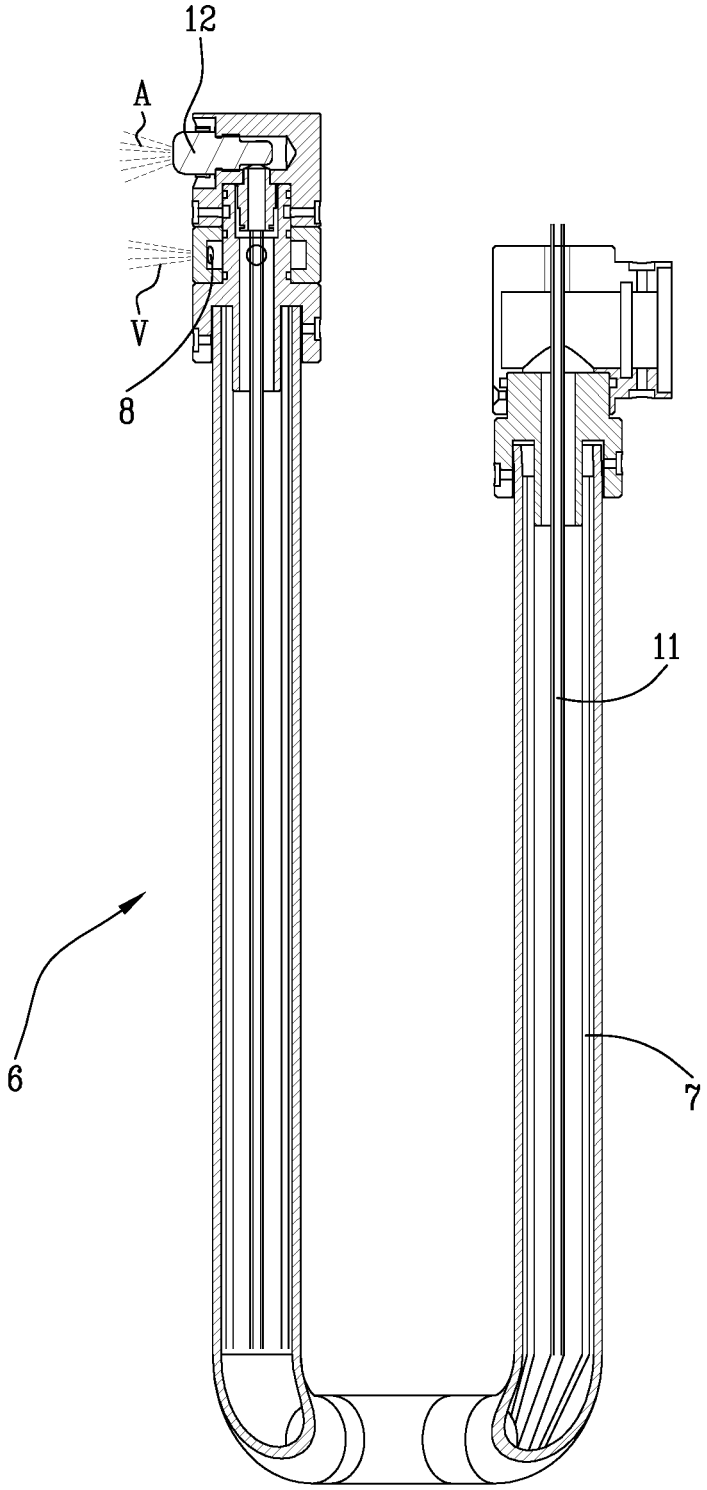
FIG. 5 shows a sectional side view of a component of the multifunctional device.
Figure 6:
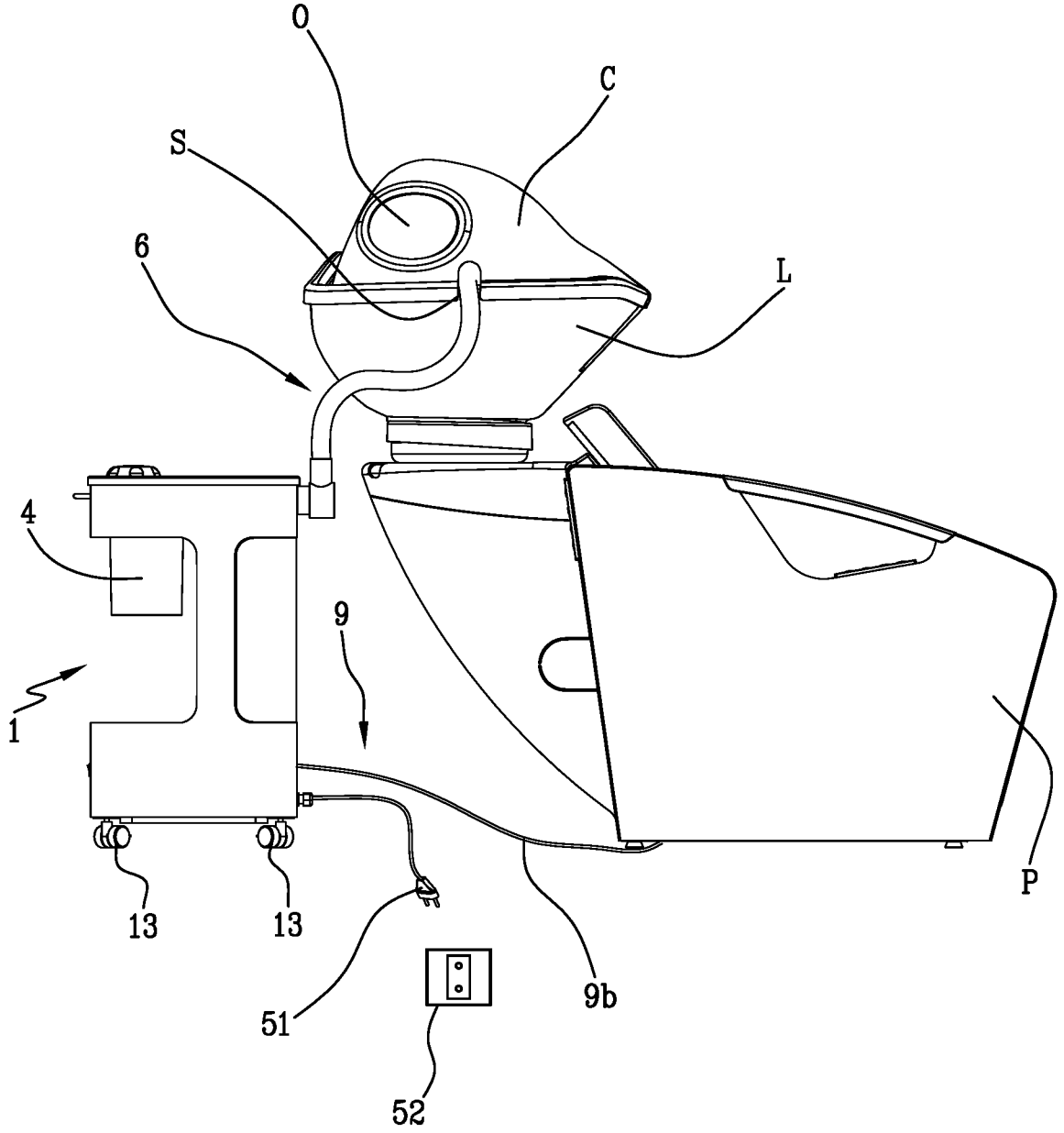
FIG. 6 shows an example of application of the multifunctional device.

In accordance with the appended figures, the number 1 is used to globally represent a multifunctional device for the treatment of a patient's hair and skin.

Said device 1 is defined by a box-shaped body 2 of a substantially parallelepiped shape.

A removable portion is provided at a right side 2*a* while a recess to the normal extension of the parallelepiped body is provided at a left side 2*b*.

The box-shaped body 2 provides at its base a plurality of swivelling wheels 13, preferably four, to allow the movement of the device 1 on the ground.

A handle 19 is present at the left side 2*b* to facilitate the movement operations of the device 1.

The box-shaped body 2 provides on its top a command keypad 3 adapted to activate and lock the various features of the device 1 described in the continuation of this description.

A control and command board 15 is present inside the box-shaped body, adapted to govern, following activation of the commands of the keypad 3, the various functions of the device 1.

A tank 4 is present inside the box-shaped body 2 for the production of steam V.

Said tank 4 is preferably applied at the left side 2*b*, where there is a recess, in order to allow the user to be able to constantly monitor the tank 4 and perceive both its correct operation and the fill level of the tank.

Moreover, in the case in which the tank 4 is to be removed for cleaning operations, the application of the same at the recess allows easy disassembly and removal of the tank itself.

Heating means 5 is provided inside the tank 4, adapted to heat a volume of water W contained in the tank.

Said heating means 5 is preferably formed by a heating element 16 having a substantially U shape to transversely pass through the tank 4.

At the top, said heating element 16 is connected to a cap 24 adapted to close the tank 4.

At the right side 2*a*, the box-shaped body has dispensing means 6 comprising at least a first conduit 7 for dispensing steam V.

Said first conduit 7 is in fluid communication with the tank 4 and is equipped with an outlet mouth 8 for dispensing steam V.

Said outlet mouth 8 favours conveying steam towards a given area, the head of the patient, and is generally applied in such a way as to open at a washbasin L of a backwash chair unit P.

Said dispensing means 6 further comprises a second conduit 11 in communication below with said tank 4 and connected above to a nebulizer 12 to allow the dispensing of cold atomized water A.

The first and second conduit 7,11 open into a common dispensing lance 20 to ensure better handling of the means for dispensing steam and cold nebulized water.

The device 1 is supplied with water through a supply conduit 9. Said supply conduit 9 has a first end 9*a* in fluid communication with the tank 4 and a second end 9*b* in fluid communication with a water supply source.

The second end 9*b* can be connected to the water supply conduits of the chair P or directly to the aqueduct mains reaching the beauty salon where the device 1 is used.

Through the keypad 3, the supply conduit 9 refills water in the tank 4 in a manner that will be better described below.

The device 1 then provides filtering means 10 that intercepts the water flowing along the supply conduit and transforms the water into demineralized water. The demineralized water reaches the tank 4 to be heated by the heating element 16 and be transformed into steam conveyed in the first conduit 7.

Said filtering means 10, preferably defined by a cartridge internally containing ion exchange resins, is placed at the left side 2*b*, i.e. at the removable part.

In this way, when the filtering means has terminated its filtering power, it is possible to replace the cartridge by removing, from the left side 2*b*, the removable part and replacing the cartridge.

The supply conduit 9 internally comprises disinfectant means 14. Said disinfectant means 14 is preferably defined by a UV lamp which with its rays irradiates the steam passing through the supply conduit 9.

In this manner, in addition to obtaining a disinfection effect, the UV ray lamp allows ionizing the steam flowing out of the supply conduit 9.

With particular reference to the control and command board 15, in addition to governing all the functionalities of the device 1, the same has a counter adapted to measure the time, in cycles or hours, of operation of the filtering means 10.

Upon approaching a determined programmed time value, the board 15 informs the user of the need to replace the filtering means 10. This information can be obtained by means of a luminous or acoustic indicator 60, or can possibly lead to the blockage of the device so as to oblige the user to change the filtering means.

The use of the filtering means 10 with a cartridge lacking filtering power can lead to the ineffectiveness of the treatments offered by the device 1, up to the failure of the same.

With particular reference to the command keypad 3, the same has a plurality of pushbuttons adapted to inform the control and command board of various functionalities of treatment implementation.

A first plurality of keys 21 is present inside the keypad for the selection of programs for the treatment of hair and skin.

Through the first plurality of keys 21 it is possible to turn the device 1 on or off, decide the time duration of the treatment, turn on (or off) the disinfectant means 14, turn on or off the treatment with steam V or cold nebulized water A.

A second plurality of keys 22 is also present in the keypad for varying the quantity of steam dispensed out of the outlet mouth 8 of the first conduit 7.

Through the selection of the "+" or "−" keys it is possible to reduce the voltage to the heating element 16 and therefore the thermal power dispensed by the same. In this way, depending on the type of treatment it will be possible to dispense more or less steam from the outlet mouth 8.

There is also a third plurality of keys 23 in the keypad 13 for allowing the automatic, or manual, refilling of the tank upon exceeding a minimum level of volume of water W contained in the tank 4.

The tank 4 has a first and a second sensor 17, 18 inside.

The first sensor 17, preferably a thermostat, detects the rise in temperature inside the tank 4, and, as soon as a certain threshold value is exceeded, sends a signal to the board 15 to activate the automatic filling of the water inside the tank 4.

The second sensor 18, preferably a thermostat, detects the rise in temperature inside the tank 4, and, as soon as a further determined threshold value is exceeded, sends a signal to the board 15 to command the blockage of the device 1.

In essence, the first sensor 17 operates as a system for informing the user of the need to replenish water inside the tank 4, while the second sensor 18 operates as a safety system for the device, preventing it from reaching temperatures that could compromise the correct operation of the device itself.

For the correct operation of the sensors the first threshold temperature value, detected by the first sensor 17, is less than the second temperature threshold value, detected by the second sensor 18.

The present invention can be electrically and hydraulically connected to the utilities of the beauty salon.

Alternatively, the device 1 can be hydraulically connected to the water supply conduits of a backwash chair unit P.

Above the washbasin L, the chair P has a hood C, preferably in transparent polycarbonate, to confine the steam V and the nebulized water during its use.

The hood C then provides two openings O in order to facilitate the insertion of the operator's hands and allow skin massage and hair washing.

Said hood C, in addition to containing the steam and the splashes of nebulized water, allows isolating the noise coming from the use of steam in the salon.

The present multifunctional device 1 achieves important advantages.

From an operational point of view, it can be understood how it is advantageous to provide, with a single device, multiple treatments depending on the patient's needs.

Through the first conduit 7 dispensing hot steam, various beneficial effects can be had on the hair and scalp.

The steam causes the cells of the cuticle to slightly open, then the pores of the scalp dilate and thereby stimulate glandular secretion and the microcirculation of blood.

Still thanks to steam, a dissolution of the micro-particles of smog and chemicals adhering to the hair shaft is obtained, thus allowing adequate cleansing and hydration of the hair.

On the scalp, the steam opens the pores of the skin, thereby letting the sebum exit, fluidized by the heat and by sweat.

The hair and scalp also benefit from the cold atomized water dispensed by the second conduit 11.

The small atomized molecules of cold water can penetrate between the surface cells of the cuticle of the hair shaft, favouring the adhesion and closure of the hair cuticle. Furthermore, the hair shaft better absorbs every moisturizing treatment, from conditioners to masks with nutrient oils.

The small atomized molecules of cold water induce a closing of the dilated pores after treatment with hot steam, thus contributing to the reduction of seborrhea.

Secondly, the multifunctional device 1 has several practical advantages.

Through the use of a filtering cartridge, the user is not required to have reserves of demineralized water for refilling the tank when the liquid contained therein is terminated.

Secondly, the water connection to the mains of the beauty salon or to the water conduits of the chair makes it possible to no longer have to see to filling the tank whenever the water level falls below the threshold required to perform a treatment.

The possibility of also having a dispensing lance with double output, steam and/or cold atomized water, allows, if necessary, the user to alternate treatments only by acting on the keypad.

The invention claimed is:

1. A multifunctional device (1) for the treatment of a patient's hair and skin comprising:

a box-shaped body (2), having below a plurality of swivelling wheels (13) for favouring the movement of the device (1) and having above a command keypad (3) connected to a control and command board (15) of the device (1), internally comprising a tank (4) for the production of steam (V);

a heater (5) placed inside the tank (4) for heating a volume of water (W) contained in the tank (4);

a dispenser (6) comprising a first conduit (7) for dispensing steam (V) in fluid communication with the tank (4) and having an outlet mouth (8) for concentrating a flow of steam (V);

characterized in that it comprises:

a supply conduit (9) having a first end (9*a*) in fluid communication with the tank (4) and a second end (9*b*) in fluid communication with a water supply source, adapted to supply the tank (4) following a command of the command keypad (3);

a filter (10) intercepting the supply conduit (9) to treat the incoming water, transforming it into demineralized water.

2. The device (1) according to claim 1, wherein said dispenser (6) comprises:

said first conduit (7) for dispensing steam (V);

a second conduit (11) in fluid communication below with said tank (4) and connected above to a nebulizer (12) to allow the dispensing of cold atomized water (A).

3. The device (1) according to claim 1, wherein said supply conduit (9) at the first end (9*a*) is irradiated by a disinfector (14) to disinfect and ionize the steam (V) in input to the dispenser (6).

4. The device al according to claim 1, wherein said control and command board (15) has a logical counter (50) adapted to measure the time of use of the filter (10); said control and command board (15) indicating to the user a state of wear of the filter (10) upon detection by the logical counter (50) of a time of use of the filter (10) greater than a predetermined value.

5. The device (1) according to claim 1, wherein said command keypad (3) comprises:

a first plurality of keys (21) for the selection of programs for the treatment of hair and skin;

a second plurality of keys (22) for varying the amount of steam (V) dispensed by the dispenser (6);

a third plurality of keys (23) to allow the automatic refilling of the tank (4) upon exceeding a minimum water level value in the tank (4); said automatic refilling being activated by the control and command board (15).

6. The device (1) according to claim 5, wherein said second plurality of keys (22) activates a heating element (16), placed inside the tank (4), varying the supply voltage and consequently the thermal power applied to allow an adjustment of the amount of steam (V) dispensed outside of the dispenser (6).

7. The device (1) according to claim 1, wherein said tank (4) internally comprises:

a first sensor (17) adapted to detect the rise in temperature inside the tank (4), and, as soon as a first threshold value is exceeded, to command the control and command board (15) to activate a topping up of water to the tank (4), or to signal, through suitable acoustic and/or visual indicators (60), having exceeded the minimum water volume level contained in the tank (4);

a second sensor (18) adapted to detect the rise in temperature inside the tank (4), and, as soon as a second threshold value is exceeded, to command the control and command board (15) to activate a safety blockage of the device (1).

8. The device (1) according to claim 7, wherein said second threshold value, detected by the second sensor (18), is greater than the first threshold value, detected by the first sensor (17).

9. A backwash chair unit comprising:

a chair (P) for accommodating a patient in a suitable position to be subjected to a hair and skin treatment;

a washbasin (L) within which the patient places his/her head to receive treatments;

characterized in that the backwash chair unit comprises a multifunctional device (1) for the treatment of hair and skin as described in claim 1.

10. The backwash chair unit according to claim 9, wherein said multifunctional device (1) can be hydraulically connected through the supply conduit (9) to the water supply conduits of the chair (P) and electrically connected through a plug (51) to a power source (52).

11. The backwash chair unit according to claim 10, wherein said washbasin (L) provides on its top a hood (C) adapted to confine the volume of steam (V) and/or cold atomized water (A); said hood (C) comprising a pair of lateral openings (O) in order to facilitate the insertion of an operator's hands and allow skin massage and hair washing, and having a seat (S) below to accommodate the dispenser (6) so that the steam (V) and/or cold water (A) is dispensed inside a closed volume defined below by the washbasin (L) and above by the hood (C).

12. The device (1) according to claim 1, wherein said supply conduit (9) at the first end (9*a*) which is near the tank (4) is irradiated by a disinfector (14) which is a UV lamp, to disinfect and ionize the steam (V) in input to the dispenser (6).

13. The device (1) according to claim 7, wherein the first sensor (17) is a thermostat, and wherein the second sensor (18) is a thermostat.

14. The backwash chair unit according to claim 11, wherein the hood (C) is transparent polycarbonate.

* * * * *